US008611583B2

(12) United States Patent
Rapoport

(10) Patent No.: US 8,611,583 B2
(45) Date of Patent: Dec. 17, 2013

(54) COMPACT COAXIAL CROSSOVER-FREE LOUDSPEAKER

(76) Inventor: Uri Rapoport, Moshav Ben Shemen (IL)

( * ) Notice: Subject to any disclaimer, the term of this patent is extended or adjusted under 35 U.S.C. 154(b) by 17 days.

(21) Appl. No.: 13/495,722

(22) Filed: Jun. 13, 2012

(65) Prior Publication Data

US 2012/0321123 A1 Dec. 20, 2012

Related U.S. Application Data

(60) Provisional application No. 61/497,535, filed on Jun. 16, 2011.

(51) Int. Cl.
*H04R 9/06* (2006.01)

(52) U.S. Cl.
USPC ..... 381/401; 381/412

(58) Field of Classification Search
USPC ..... 381/312–330
See application file for complete search history.

(56) References Cited

U.S. PATENT DOCUMENTS

| | | | |
|---|---|---|---|
| 4,283,606 | A | 8/1981 | Buck |
| 4,357,498 | A | 11/1982 | Tsuchiya et al. |
| 5,193,119 | A | 3/1993 | Tontini et al. |
| 7,920,712 | B2 | 4/2011 | Butler |

*Primary Examiner* — Brian Ensey
*Assistant Examiner* — Norman Yu
(74) *Attorney, Agent, or Firm* — The Law Office of Michael E. Kondoudis

(57) ABSTRACT

A loudspeaker assembly that converts electrical signal into sound waves in the full spectral range of an audio voltage. The loudspeaker assembly includes: a plurality of drivers; and a hollow volume permanent magnet that accommodates the voice coils. Each driver includes a cylindrically shaped voice coil affixed to a matching diaphragm. Each voice coil is configured coaxially in a cylindrical assembly, which is in electrical communication with an incoming audio voltage. Each driver is adapted to reciprocally move along the main longitudinal axis of each voice coil when stimulated by said incoming audio voltage.

18 Claims, 6 Drawing Sheets

COMPACT COAXIAL CROSSOVER-FREE LOUDSPEAKER

FIELD OF THE INVENTION

The present invention generally relates to a loudspeaker system.

The present invention particularly relates to a loudspeaker driven directly by the full spectral range of an audio voltage.

BACKGROUND OF THE INVENTION

Electronic power amplifying technology and digital optical disk recording technology of the recent years are providing high fidelity audio signals. Thus in any sound system ultimate quality depends on the speakers. The best recording, encoded on the most advanced storage device and played by a top-of-the-line deck and amplifier, can have a quality sound only if the system is hooked up to high quality speakers. A system's speaker is the component that takes the electronic signal stored on equipment like CDs tapes and DVDs and converts them into actual sound that we can hear.

The loudspeaker is a transducer converting electrical drive signal into sound waves. The core element of the transducer is the driver, which produces sound waves by rapidly vibrating a flexible cone, or diaphragm. The cone, usually made of paper, plastic or metal, is attached on the wide end to the suspension, a rim of flexible material that allows the cone to move, and is attached to the driver's metal frame.

The narrow end of the cone is connected to the voice coil, an electromagnet commonly made of electrical wire windings around a core of magnetic material and placed in the center of a permanent magnet ring. An electrical current running through the wire creates a varying magnetic field around the coil, interacting with the permanent magnet ring to apply force directed along the cone axis to move the voice coil freely back and forth along the cone axis.

Physical size of this audio transducer technique, limit the frequency range that a given driver can output. A large and heavy voice coil adapted for operating accurately at low audio frequencies, operates poorly for the higher audio frequencies and vice versa, a small and light voice coil adapted for operating accurately at high audio frequencies, operates poorly for the lower audio frequencies. Thus, three independent drivers, commonly produce the entire sound spectral range from the lowest sound wave frequencies up to the highest audible frequency of approximately 20 KHz. Woofers are the biggest drivers, and are designed to produce low frequency sounds. Midrange drivers produce a range of frequencies in the middle of the sound spectrum. Tweeters are the units, designed to produce the highest frequencies. Consequently, The input to each driver contains the spectral components of the audio signal, which are compatible with the driver operational frequency by having a device known in the art by the name: crossover. The crossover includes a low pass filter, a band pass filter and a high pass filter. The input to the crossover is an audio voltage driven by the output of the audio power amplifier. The output of the low pass filter is used to drive the voice coil of the woofer. The output of the band pass filter is used to drive the voice coil of the mid range driver and the output of the high pass filter is used to drive the tweeter. The sound created by the three transducers effectively combines the three spectral ranges into a single consecutive audible spectral range.

Commonly, a loudspeaker system is constructed by a single common housing structure including the crossover filter and the three independent drivers. Consequently, a high quality loudspeaker has a large physical size. Furthermore, this loudspeaker configuration is highly sensitive to tuning between the three voice coil drivers and the corresponding crossover output voltages, resulting performance degradation. In view of the fact that loudspeakers are the 'weak link' of an audio system, systems and methods were devised in the past years for improving the sound fidelity of loudspeakers.

U.S. Pat. No. 4,283,606 enclosed herein by reference discloses an acoustic filter for use in combination with a coaxial loudspeaker system, which includes a low frequency loudspeaker and a high frequency loudspeaker, which is axially aligned with the low frequency loudspeaker. The acoustic filter includes a pair of parallel, perforated sheets which are separated from each other a suitable distance and which are joined together at their peripheries in any appropriate manner so that they enclose an airspace there between in order to form a single section filter. The acoustic filter is disposed between the low frequency loudspeaker and the high frequency loudspeaker so the acoustic filter inhibits the high frequency sounds of the high frequency loudspeaker from interacting with the internal sidewall of the conically shaped diaphragm of the low frequency loudspeaker.

U.S. Pat. No. 4,357,498 enclosed herein by reference discloses a coaxial type planar diaphragm loudspeaker system in which a plurality of coaxially arranged polygonal diaphragms are provided with separate magnetic circuits. Each magnetic circuit includes two parallel plate along each side of the diaphragm with a voice coil bobbin having the same shape as the corresponding polygonal diaphragm coupled thereto with a voice coil attached to the opposite end and disposed in the gap formed in the magnetic circuit. The area of the diaphragm falling within the juncture line between the voice coil bobbin and diaphragm is made equal to the area of the diaphragm outside the juncture line so as to eliminate split vibration.

U.S. Pat. No. 5,193,119 enclosed herein by reference discloses a multiple loudspeaker includes a housing and a first speaker (a woofer) supported by the housing. The first speaker includes a first diaphragm. A support for supporting a second speaker (a tweeter) is provided, and the housing supports the tweeter support. A portion of the support for the tweeter is spaced from the first diaphragm (the woofer diaphragm), and the tweeter is spaced from the woofer diaphragm. The tweeter support can be in the form of a protective grill or in the form of an annular ring. A sponge damper is attached to the spaced portion of the tweeter support. The tweeter includes a second diaphragm (the diaphragm for the tweeter) and a piezoelectric transducer. The tweeter diaphragm is attached to and is supported by the sponge damper. The piezoelectric transducer is attached to and supported by the tweeter diaphragm and is spaced from the woofer diaphragm. The piezoelectric transducer faces and is spaced from the woofer without an obstruction being present between the piezoelectric transducer and the woofer diagram. The surface of the woofer diaphragm reflects the sound waves emitted from the rear of the piezoelectric transducer and the rear of the tweeter diaphragm.

U.S. patent application Ser. No. 11/450,900 enclosed herein by reference discloses a loudspeaker is provided for receiving an electrical signal and transmitting an acoustic signal through a transmission medium. The system includes generally two elements: a coaxial transducer and an acoustic transformer. The coaxial transducer includes a high-frequency driver and a mid-frequency driver that are coaxially arranged. The acoustic transformer is acoustically coupled to the coaxial transducer and includes an initial horn section that expands from a first end to a second end in a direction away from the coaxial transducer. The initial horn section defines a plurality of openings there through, such that the initial horn section is acoustically opaque to high-frequency acoustic signals to thereby function as a wave-guide for the high-frequency acoustic signals, while it is acoustically transparent to mid-frequency acoustic signals.

Hence there is still a long felt need for a compact and high sound quality loudspeaker system that is insensitive to audio filter tuning variations with respect to transducer spectral response curves.

SUMMARY OF THE INVENTION

Accordingly, it is a principal object of the invention is to disclose a loudspeaker consisting of drivers configured coaxially in common volume. An audio voltage is applied to each of the coaxial drivers. Inasmuch as every driver optimally responds to a different range of the audio spectrum, the drivers generate sound at the combined spectral range by accommodating their integrated spectral filtering function in a monotonous manner.

In accordance with a preferred embodiment of the present invention, it is the object of the invention to disclose:

A loudspeaker system comprising:

(i) A plurality of drivers having an incoming audio voltage. Each driver comprising a cylindrically shaped voice coil affixed to a matching diaphragm. The voice coils are configured coaxially in a cylindrical assembly.

(ii) A hollow, cylindrically shaped, permanent magnet. The assembly of voicecoils is disposed within the hollow volume of the permanent magnet.

Audio voltage applied to the voice coils generates a magnetic field within the voicecoil assembly. The interaction between said magnetic field of the permanent magnet and the magnetic field created by the voice coils exert force on the drivers and move the diaphragms axially with the voicecoil assembly. Motion of the diaphragms creates sound waves. Wherein each of the drivers reacts to the audio voltage according to the spectral content of the applied audio voltage and the spectral response curve of the driver and the combined spectral response curve of the loudspeaker is flat across the sound spectrum.

It is one object of the present invention to provide a loudspeaker assembly, wherein said loudspeaker assembly is adapted to convert electrical signal into sound waves in the full spectral range of an audio voltage. The loudspeaker assembly comprising:

(i) a plurality of drivers; each of which comprising a cylindrically shaped voice coil affixed to a matching diaphragm; said voice coils are configured coaxially in a cylindrical assembly; each of said voice coil is in electrical communication with an incoming audio voltage; each of said drivers is adapted to reciprocally move along the main longitudinal axis of said voice coil when stimulated by said incoming audio voltage; and, (ii) a hollow volume permanent magnet, adapted to accommodate said voice coils.

It is another object of the present invention to provide the loudspeaker as defined above, wherein said permanent magnet is cylindrically shaped.

It is another object of the present invention to provide the loudspeaker as defined above, wherein said movement of each of said drivers is defined according to parameters selected from a group consisting of the applied audio voltage and the spectral response driver.

It is another object of the present invention to provide the loudspeaker as defined above, wherein the shape of said diaphragms is selected from a group consisting of conically shape or dome shape.

It is another object of the present invention to provide the loudspeaker as defined above, wherein said diaphragms have an aspherical shape designed for optimal performance.

It is another object of the present invention to provide the loudspeaker as defined above, wherein said diaphragms have thin walls made of paper, metal or plastic.

It is another object of the present invention to provide the loudspeaker as defined above, wherein said loudspeaker additionally comprising a single woofer coil and three ferromagnetic cores actuating said voice coil assembly.

It is another object of the present invention to provide the loudspeaker as defined above, wherein three distinct spectral range voltages drives each of said drivers.

It is another object of the present invention to provide the loudspeaker as defined above, wherein said spectral response curves of said drivers are combined to an overall spectral response that is flat through the entire spectrum of the generated sound.

It is another object of the present invention to provide the loudspeaker as defined above, wherein said combined spectral response curve is monotonous and steady.

It is another object of the present invention to provide the loudspeaker as defined above, wherein said combined spectral response curve is insensitive to tuning variation between audio voltage filter outputs and said driver spectral response curves.

It is another object of the present invention to provide the loudspeaker as defined above, wherein said drivers are packaged in one compact loudspeaker unit.

It is another object of the present invention to provide the loudspeaker as defined above, wherein operates does not accommodate electronic filtering of said audio driving voltage.

It is another object of the present invention to provide the loudspeaker as defined above, comprising a woofer, a midrange driver and a tweeter.

It is another object of the present invention to provide the loudspeaker as defined above, wherein said woofer moves within independently and within the hollow volume of said midrange driver, which moves independently within said hollow volume of said woofer.

It is another object of the present invention to provide the loudspeaker as defined above, wherein said woofer moves independently within said hollow volume of said permanent magnet.

It is another object of the present invention to provide the loudspeaker as defined above, wherein the response curve of said woofer is flat in the low frequency range of the sound wave spectrum.

It is another object of the present invention to provide the loudspeaker as defined above, wherein said response of said midrange driver is flat at the middle frequency range of the sound wave spectrum.

It is another object of the present invention to provide the loudspeaker as defined above, wherein said response of said tweeter is flat at the frequency range of the sound wave spectrum.

It is another object of the present invention to provide a method for converting electrical signal into sound waves in the full spectral range of an audio voltage. The method comprises steps selected inter alia from:

a. providing a plurality of cylindrically shaped voice coil;

b. providing a plurality of diaphragm;

c. coupling said plurality of cylindrically shaped voice coil to said plurality of diaphragm;
d. providing a hollow volume permanent magnet;
e. accommodating said voice coils within said hollow volume permanent magnet;
f. electrical communicating said plurality of cylindrically shaped voice coil to an incoming audio voltage;
g. applying any audio voltage on said voice coils thereby (i) generating a magnetic field within said voice coil; and, (ii) reciprocally moving said plurality of voice coil and plurality of diaphragm; and,
h. converting said audio voltage applied to sound waves in the full spectral range of an audio voltage.

It is another object of the present invention to provide the method as defined above, additionally comprising step of shaping said permanent magnet in a cylindrical shape.

It is another object of the present invention to provide the loudspeaker as defined above, additionally comprising step of defining the movement of each of said voice coil coupled to said diaphragm is defined according to parameters selected from a group consisting of the applied audio voltage and the spectral response driver.

It is another object of the present invention to provide the loudspeaker as defined above, additionally comprising step of selecting the shape of said diaphragms from a group consisting of conically shape or dome shape.

It is still an object of the present invention to provide the loudspeaker as defined above, additionally comprising step of designing said diaphragms in an aspherical shape for optimal performance.

It is lastly an object of the present invention to provide the loudspeaker as defined above, additionally comprising step of packing said voice coil coupled to said diaphragm in one compact loudspeaker unit.

BRIEF DESCRIPTION OF THE DRAWING AND FIGURES

For a better understanding of the invention with regard to embodiments thereof, reference is made to the accompanying drawings, in which the numerals designate corresponding elements in sections throughout and in which FIG. 1 illustrates a schematic block diagram of an audio system according to an embodiment of the present invention;

Figure 5:
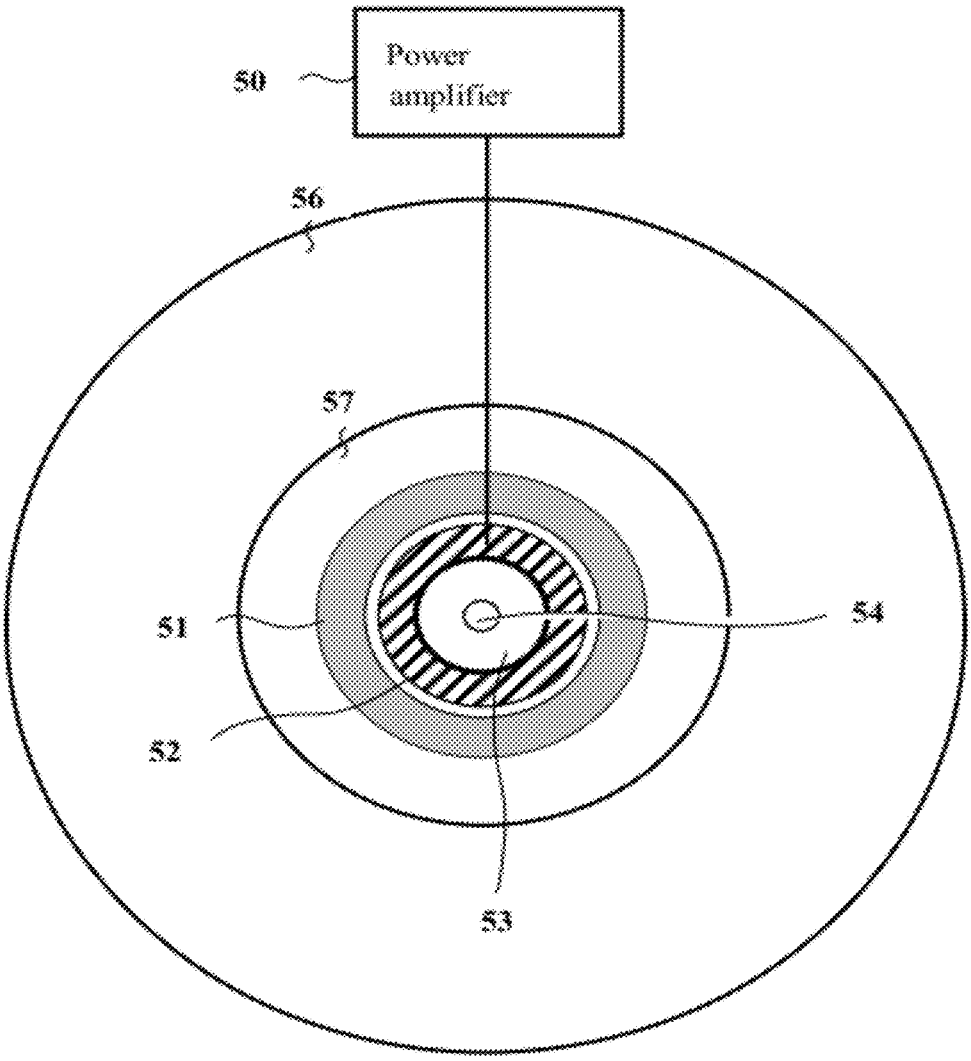
Figure 6:
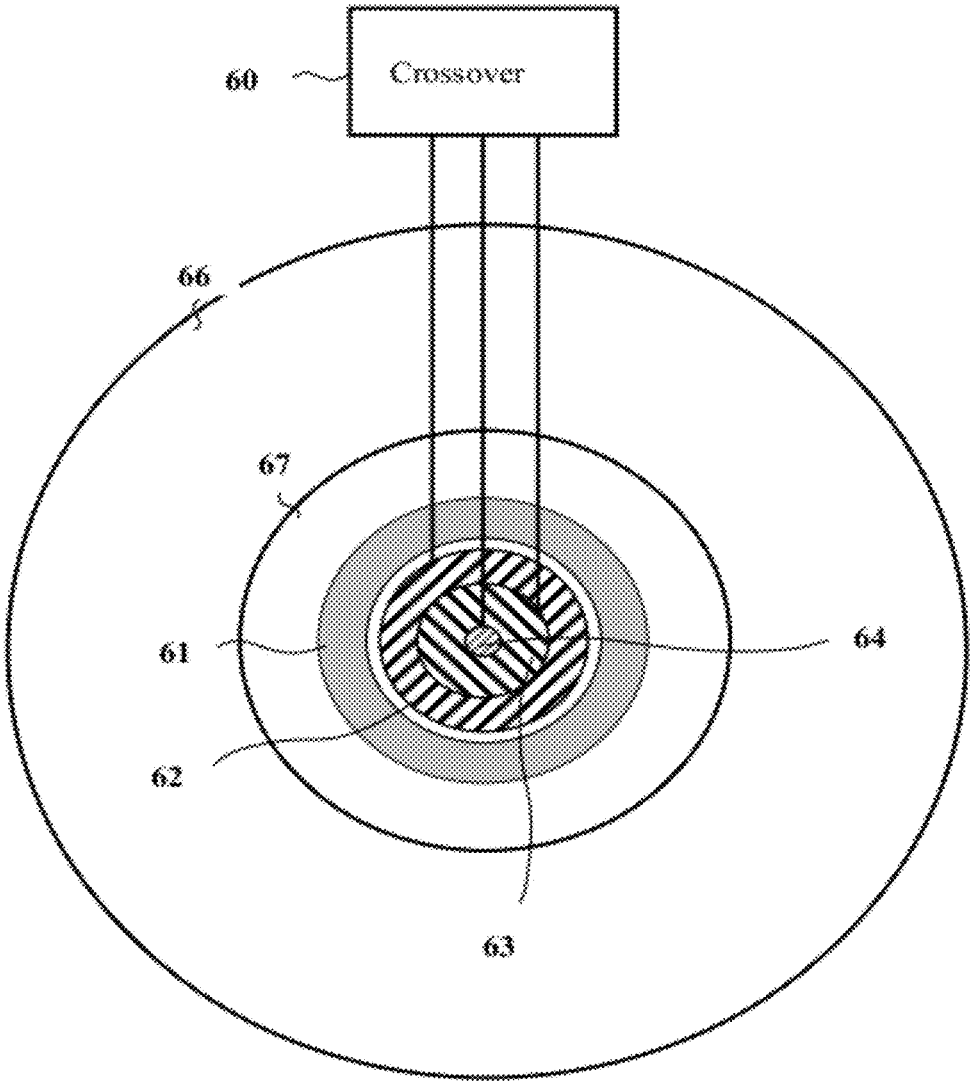

FIG. 5 illustrates a non-dimensionally scaled cross sectional view perpendicular to the common axis of the loudspeaker having a single coil actuating the three speaker drivers according to an embodiment of the present invention and FIG. 6 illustrates a non-dimensionally scaled cross sectional view perpendicular to the common axis of the loudspeaker having three spectral range voltages actuating the three speaker drivers according to an embodiment of the present invention;

DESCRIPTION OF THE PREFERRED EMBODIMENTS

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a loudspeaker.

In the following detailed description, numerous specific details are set forth in order to provide a thorough understanding of embodiments of the present invention. However, those skilled in the art will understand that such embodiments may be practiced without these specific details. Reference throughout this specification to "one embodiment" or "an embodiment" means that a particular feature, structure, or characteristic described in connection with the embodiment is included in at least one embodiment of the invention. Thus, the appearances of the phrases "in one embodiment" or "in an embodiment" in various places throughout this specification are not necessarily all referring to the same embodiment or invention. Furthermore, the particular features, structures, or characteristics may be combined in any suitable manner in one or more embodiments.

The drawings set forth the preferred embodiments of the present invention. The embodiments of the invention disclosed herein are the best modes contemplated by the inventors for carrying out their invention in a commercial environment, although it should be understood that various modifications are accomplished within the parameters of the present invention.

The term 'loudspeaker' or 'speaker' relates hereinafter in a non-limiting manner to an electro-acoustic transducer that converts electrical signals into sounds that are loud enough to be heard at a distance.

The term 'speaker diaphragm' relates hereinafter in a non-limiting manner to a thin cone or dome shaped structure made of paper plastic of metal affixed an electromagnet. Vibrations of the speaker diagram by the electromagnet moving back and forth create the speaker sound waves.

The term 'voice coil' relates hereinafter in a non-limiting manner to an electromagnet moving back and force when an audio signal is applied to the coil. The movement is attributed to a force created by interaction of between the magnetic field of a ring shaped permanent magnet and the magnetic field of the electromagnet.

The term 'driver' relates hereinafter in a non-limiting manner to a diaphragm affixed to a voice coil that generates the sound wave when moving back and forth.

The term 'permanent magnet' relates hereinafter in a non-limiting manner to a special material that behaves magnetically for a long time all by itself.

The term 'woofer' relates hereinafter in a non-limiting manner to a speaker driver designed to reproduce low frequencies.

The term 'midrange' relates hereinafter in a non-limiting manner to the middle part of the audio spectrum.

The term 'tweeter' relates hereinafter in a non-limiting manner to a speaker driver designed to reproduce high frequencies.

The term 'spectral response curve' relates hereinafter in a non-limiting manner to a graphic presentation of the spectral response of a driver'

The term 'speaker crossover' relates hereinafter in a non-limiting manner to an electronic filtering device that is used to send the appropriate spectral range signal to the correct drivers.

The term 'aspherical surface' relates hereinafter in a non-limiting manner to a surface deviating from a perfectly spherical shape.

The present invention discloses a loudspeaker consisting of drivers configured coaxially in a common volume. The audio signal power voltage is applied to each of the coaxial drivers. Inasmuch as every driver optimally responds to a different range of the audio spectrum, the drivers generate sound at the combined spectral range by accommodating their integrated spectral filtering function in a monotonous manner.

The loudspeaker is accommodating a space saving structure by incorporating the three drivers in the same volume and saving the space of a crossover unit, which is not required by the present invention.

Furthermore, the overall spectral response by the filtering operation of the spectral response curves of the drivers, accommodates a combined sound spectral response curve, which is substantially monotonous and steady throughout the entire spectral range of the sound.

Figure 1:
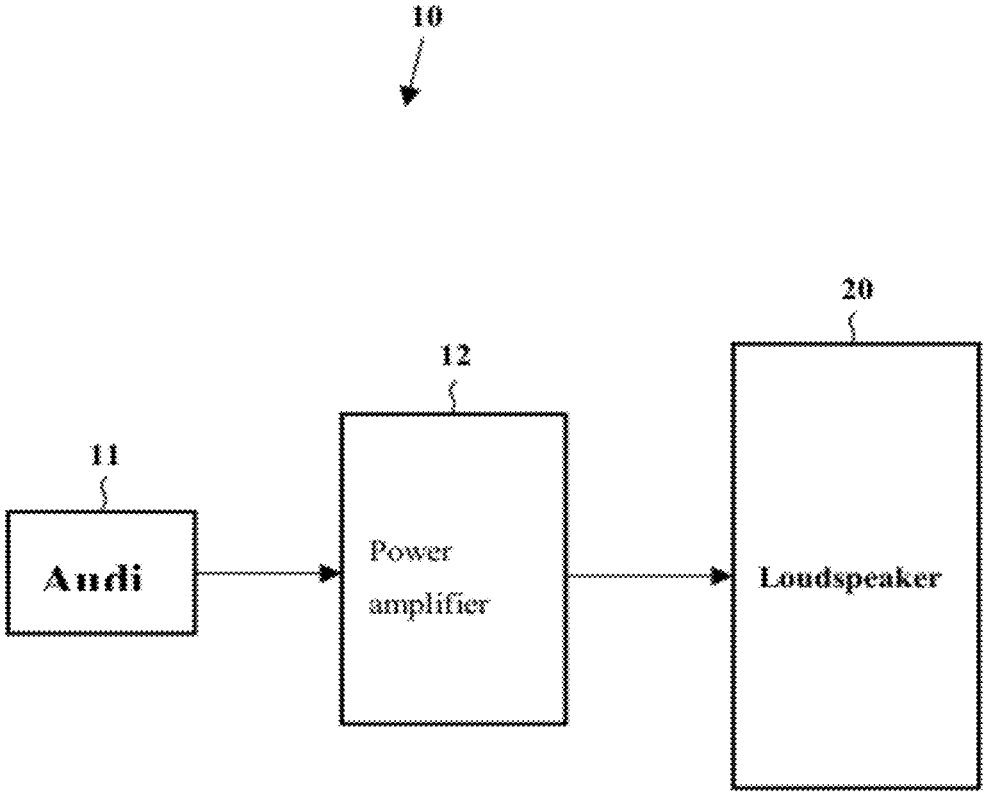

Reference is now made to FIG. 1, a schematic block diagram of an audio system accommodating an embodiment of the loudspeaker. System 10 consists of an output audio signal of audio source 11 feeding a power amplifier 12, which outputs a high power audio voltage feeding the loudspeaker 20. Loudspeaker 20 accommodating woofer, midrange driver and a tweeter, driven commonly by the incoming audio voltage, is configured coaxially. The mutually generated sound has a flat and monotonous spectrum through the entire spectral range.

Figure 2:
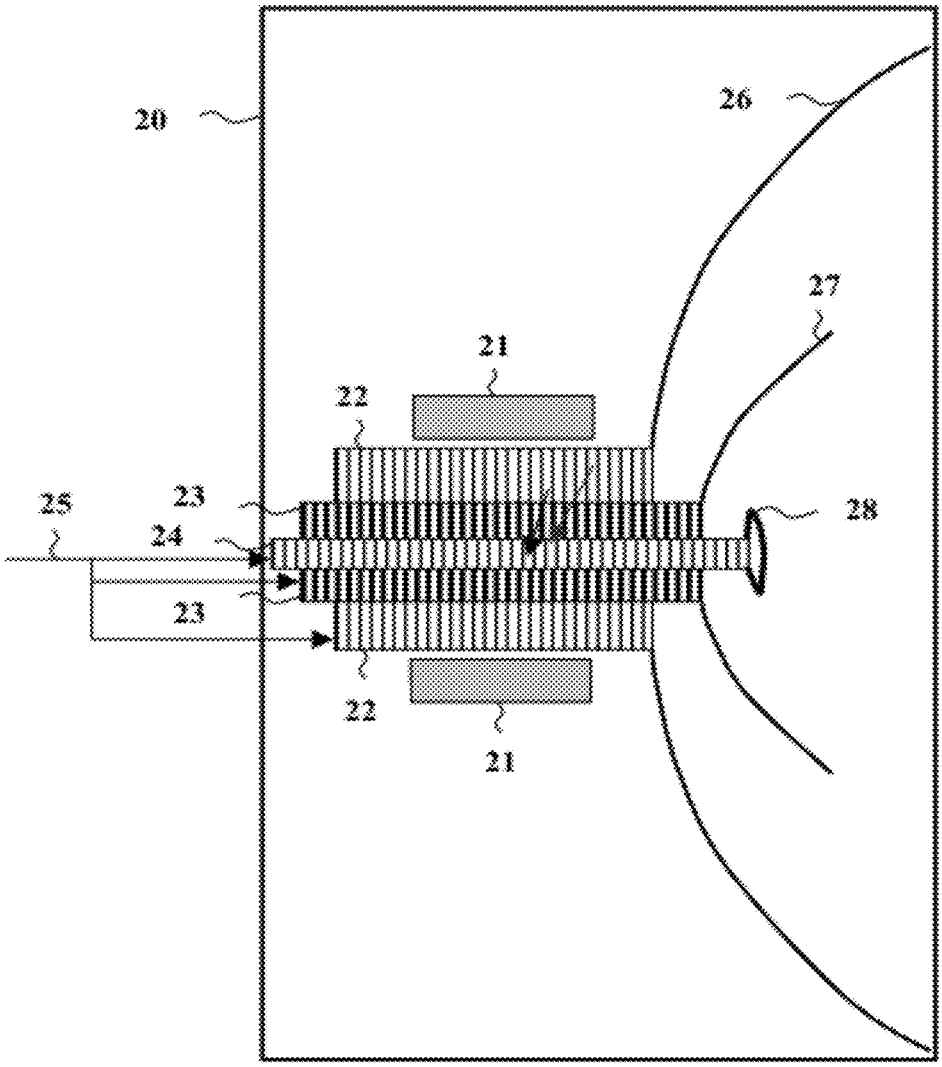
FIG. 2 illustrates a non-dimensionally scaled cross sectional view along the common axis of the loudspeaker according to an embodiment of the present invention.

Reference is now made to FIG. 2, a cross sectional view parallel the common axis of loudspeaker 20. Cylindrically shaped hollow voicecoil 22 affixed to conical diaphragm 26 of the woofer, exerts force on diaphragm 26, which is proportional to the applied audio voltage 25 at the spectral range that is compatible with the spectral response curve of the woofer. Likewise, cylindrically shaped hollow voicecoil 23 of the affixed to the conical shaped diaphragm 27 of the midrange driver exerts force on diaphragm 27, which is proportional to the applied audio voltage 25 at the spectral range that is compatible with the spectral response curve of the midrange driver. Similarly, cylindrically shaped hollow voice coil 24 of the affixed to the dome shaped diaphragm 28 of the tweeter, exerts force on diaphragm 28, which is proportional to the applied audio voltage 25 at the spectral range that is compatible with the spectral response curve of the tweeter. Voicecoil 24 moves freely within voicecoil 23, which moves freely within voicecoil 22. Voicecoils 22, 23 and 24 are disposed within a hollow volume of a cylindrically shaped hollow permanent magnet 21. When audio voltage 25 is applied mutually to voice coils 22, 23 and 24 the voice coils generate an electromagnetic field. An interaction between the magnetic field of the permanent magnet and the magnetic field generated in each of the voicecoils exert force on voice coils 22, 23 and 24 that mutually thrust the voice coils along the common cylindrical axis. Consequently, diaphragms 26, 27 and 28 affixed to the voicecoils move mutually, each responding to their distinct mechanical spectral response range and generate the sound waves. The woofer driver, which is adapted to move at the low frequency range, generates the low frequency spectral range of the sound. The midrange driver, which is adapted to move at the middle frequency range, generates the low frequency spectral range of the sound. The tweeter, which is adapted to move at the high frequency range, generates the high frequency spectral range of the sound. Inasmuch that audio voltage 25 is applied mutually to the three loudspeaker drivers and the generated sound is combined from the particular spectral range response of the three drivers without having to electrically filter the audio voltage into three distinct spectral ranges, a crossover device is unnecessary for the loudspeaker. Furthermore, combining the entire sound spectrum from the mechanical frequency responses of the drivers accommodates a contiguous, monotonous and steady spectral response curve of the loudspeaker, which is insensitive to tuning variations between the electrical filter of the crossover device and the frequency responses of the drivers, as in presently available loudspeakers of the prior art.

Figure 3:
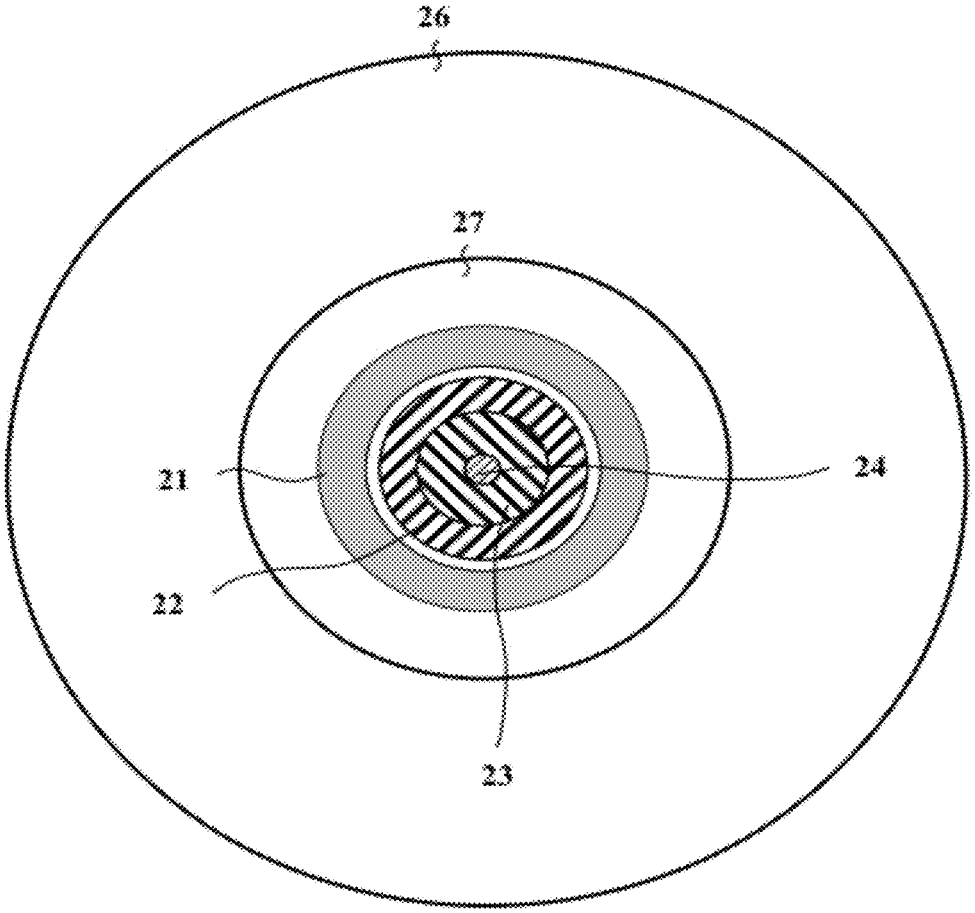
FIG. 3 illustrates a non-dimensionally scaled cross sectional view perpendicular to the common axis of the loudspeaker according to an embodiment of the present invention.

Reference is now made to FIG. 3, a cross sectional view of the loudspeaker perpendicular to the main axis of the loudspeaker. Cylindrically shaped voicecoil 24 of the tweeter is disposed within the hollow voicecoil 23 of the midrange driver. Voicecoil 23 of the midrange driver is disposed within the hollow voicecoil 22 of the woofer. The assembly of voice coils 22, 23 and 24 are disposed within the hollow volume of cylindrically shaped permanent magnet 21. Diaphragm 26 of the woofer is affixed to voicecoil 22. Likewise, diaphragm 27 is affixed to voicecoil 23 of the midrange driver. The voice coil assembly obscures the diaphragm of the tweeter affixed to voicecoil 24. An audio voltage, applied mutually to voicecoils 21, 22 and 23, generates a magnetic field within the voicecoil assembly. The interaction between the magnetic field of permanent magnet 21 and the magnetic field of the voicecoil assembly exerts force on each of the voicecoils, which thrusts the voice coils and the affixed diaphragms axially and independently.

The diaphragm surfaces have a shape selected from any desired aspherical section designed to optimize the quality of the generated sound.

Figure 4:
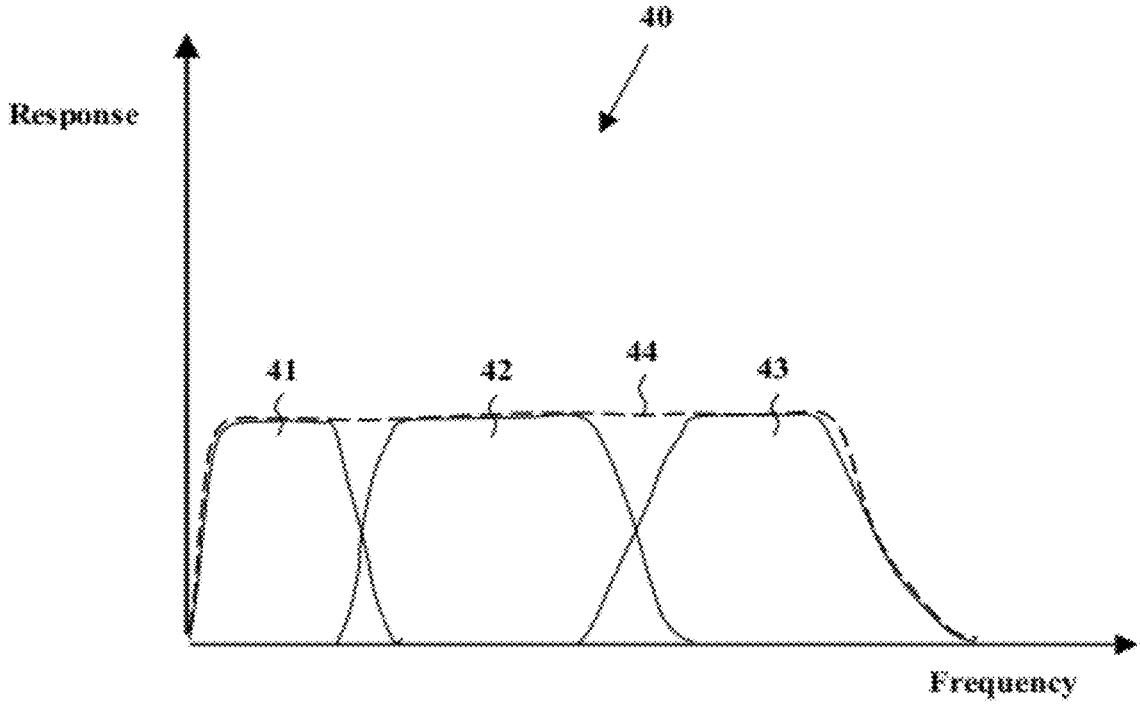
FIG. 4 illustrates a schematic of a graph characterizing the sound spectrum at the output of the loudspeaker according to an embodiment of the present invention.

Reference is now made to FIG. 4 a graph schematic 40 of the spectral response of the loudspeaker. The horizontal axis of the graph is the audio frequency in Hz units. The vertical axis is the response of the loudspeaker defined by the ratio between the driver thrust and the applied audio voltage. Graph 41, which is the response curve of the woofer, is flat at a range of low frequency and drops off sharply at the beginning and the end of the flat range. Graph 42, which is the response curve of the midrange driver, is flat at the mid frequency range and drops off sharply at the beginning and the end of the flat range. Graph 43, which is the response curve of the tweeter is flat at the high frequency range and drops off sharply at the beginning and the end of the flat range. Each of the response curves is flat at the high frequency range and drops off sharply at the beginning and the end of the flat range.

The audio voltage and the resultant thrust are applied concurrently to the three drivers. Inasmuch as the three coaxial drivers fluctuate concurrently, the response curve of the entire loudspeaker 44 is combined from the sum of the three individual response curves. Hence the combined response is flat across the entire sound spectrum. The sound spectral response curve, which is entirely dependent on the individual responses, is steady, as opposed to present art responses, which are sensitive to tuning variations between the electrical signals from the crossover and the response curves of the drivers.

Reference is now made to FIG. 5, a cross sectional view of the loudspeaker perpendicular to the main axis of the loudspeaker. The audio voltage output of power amplifier 50 drives a single woofer coil, which actuates the loudspeaker of this embodiment. Cylindrically shaped ferromagnetic core 54 of the tweeter is disposed within the hollow ferromagnetic core 53 of the midrange driver. Ferromagnetic core 53 of the midrange driver is disposed within the hollow 52 voicecoil of the woofer. The assembly of voicecoil 52, ferromagnetic cores 53 and 54 are disposed within the hollow volume of cylindrically shaped permanent magnet 51. Diaphragm 56 of the woofer is affixed to voicecoil 52. Likewise, diaphragm 57 is affixed to ferromagnetic core 53 of the midrange driver. The voice coil assembly obscures the diaphragm of the tweeter affixed to ferromagnetic core 54. An audio voltage, applied to voicecoil 51, generates a magnetic field within the voicecoil assembly. The interaction between the magnetic field of permanent magnet 51 and the magnetic field of the voicecoil assembly exerts force on each of the drivers, which actuates the three drivers mutually and independently.

Reference is now made to FIG. 6, a cross sectional view of the loudspeaker perpendicular to the main axis of the loudspeaker. The loudspeaker of this embodiment utilizes a traditional crossover device 60 segregating the audio voltage into three voltages, each voltage characterized by a spectral range compatible with the spectral response curve of the corresponding driver. Cylindrically shaped voicecoil 64 of the tweeter is disposed within the hollow voicecoil 63 of the midrange driver. Voicecoil 63 of the midrange driver is disposed within the hollow voicecoil 22 of the woofer. The assembly of voice coils 62, 63 and 64 are disposed within the hollow volume of cylindrically shaped permanent magnet 61. Diaphragm 66 of the woofer is affixed to voicecoil 62. Likewise, diaphragm 67 is affixed to voicecoil 63 of the midrange driver. The voice coil assembly obscures the diaphragm of the tweeter affixed to voicecoil 64. A separate spectral range of the audio voltage, applied to voicecoils 61, 62 and 63, generates a magnetic field within the voicecoil assembly. The interaction between the magnetic field of permanent magnet 61 and the magnetic field of the voicecoil assembly exerts force on each of the voicecoils, which thrusts the voice coils and the affixed diaphragms axially and independently.

It will be appreciated that the formerly described loudspeaker may be varied in many ways including, changing the number of coil drivers starting from two drivers up to any practical number of drivers and devising an overall flat spectral response curves in the most effective manner.

It should also be appreciated that the above description of methods and apparatus are to be interpreted as including apparatus for carrying out the methods, and methods of using the apparatus.

For the main embodiments of the invention, the particular selection of type and model is not critical, though where specifically identified, this may be relevant. The present invention has been described using detailed descriptions of embodiments thereof that are provided by way of example and are not intended to limit the scope of the invention. No limitation, in general, or by way of words such as "may", "should", "preferably", "must", or other term denoting a degree of importance or motivation, should be considered as a limitation on the scope of the claims or their equivalents unless expressly present in such claim as a literal limitation on its scope. It should be understood that features and steps described with respect to one embodiment may be used with other embodiments and that not all embodiments of the invention have all of the features and/or steps shown in a particular figure or described with respect to one of the embodiments. That is, the disclosure should be considered complete from combinatorial point of view, with each embodiment of each element considered disclosed in conjunction with each other embodiment of each element (and indeed in various combinations of compatible implementations of variations in the same element). Variations of embodiments described will occur to persons of the art. Furthermore, the terms "comprise," "include," "have" and their conjugates, shall mean, when used in the claims, "including but not necessarily limited to." Each element present in the claims in the singular shall mean one or more element as claimed, and when an option is provided for one or more of a group, it shall be interpreted to mean that the claim requires only one member selected from the various options, and shall not require one of each option. The abstract shall not be interpreted as limiting on the scope of the application or claims.

It is noted that some of the above described embodiments may describe the best mode contemplated by the inventors and therefore may include structure, acts or details of structures and acts that may not be essential to the invention and which are described as examples. Structure and acts described herein are replaceable by equivalents performing the same function, even if the structure or acts are different, as known in the art. Therefore, the scope of the invention is limited only by the elements and limitations as used in the claims.

The invention claimed is:

1. A loudspeaker assembly, comprising a woofer; a midrange driver; and a tweeter; wherein said loudspeaker assembly is adapted to convert electrical signal into sound waves in the full spectral range of an audio voltage, said loudspeaker assembly comprising: (i) a plurality of drivers; each of which comprising a cylindrically shaped voice coil affixed to a matching diaphragm; said voice coils being configured coaxially in a cylindrical assembly; each voice coil being in electrical communication with an incoming audio voltage; each of said drivers being adapted to reciprocally move along the main longitudinal axis of said voice coil when stimulated by said incoming audio voltage; and (ii) a hollow volume permanent magnet, adapted to accommodate said voice coils, wherein said tweeter moves independently and within a hollow volume of said midrange driver, and wherein said midrange driver moves independently within a hollow volume of said woofer.

2. The loudspeaker system according to claim 1, wherein said permanent magnet is cylindrically shaped.

3. The loudspeaker system according to claim 1, wherein said movement of each of said drivers is defined according to parameters selected from a group consisting of the applied audio voltage and the spectral response driver.

4. The loudspeaker system according to claim 1, wherein the shape of said diaphragms is selected from a group consisting of conically shape or dome shape.

5. The loudspeaker system according to claim 1, wherein said diaphragms have an aspherical shape designed for optimal performance.

6. The loudspeaker system according to claim 1, wherein said diaphragms have thin walls made of paper, metal or plastic.

7. The loudspeaker system according to claim 1, wherein said loudspeaker additionally comprising a single woofer coil and three ferromagnetic cores actuating said voice coil assembly.

8. The loudspeaker system according to claim 1, wherein three distinct spectral range voltages drives each of said drivers.

9. The loudspeaker system according to claim 1, wherein said spectral response curves of said drivers are combined to an overall spectral response that is flat through the entire spectrum of the generated sound.

10. The loudspeaker system according to claim 1, wherein said combined spectral response curve is monotonous and steady.

11. The loudspeaker system according to claim 1, wherein said combined spectral response curve is insensitive to tuning variation between audio voltage filter outputs and said driver spectral response curves.

12. The loudspeaker system according to claim 1, wherein at least one of the following is being held true (a) said drivers are packaged in one compact loudspeaker unit; (b) operates does not accommodate electronic filtering of said audio driving voltage; and any combination thereof.

13. The loudspeaker system according to claim 1, wherein said woofer moves independently within said hollow volume of said permanent magnet.

14. The loudspeaker system according to claim 1, wherein the response curve of said woofer is flat in the low frequency range of the sound wave spectrum.

15. The loudspeaker system according to claim 1, wherein said response of said midrange driver is flat at the middle frequency range of the sound wave spectrum.

16. The loudspeaker system according to claim 1, wherein said response of said tweeter is flat at the frequency range of the sound wave spectrum.

17. A method of converting electrical signal into sound waves in the full spectral range of an audio voltage, comprising:

Providing a plurality of cylindrically shaped voice coils and a plurality of diaphragms, each cylindrically shaped voice coil being respectively coupled to a diaphragm, the coupled cylindrically shaped voice coils and diaphragms yielding a woofer, a midrange driver and a tweeter;

providing a hollow volume permanent magnet;

accommodating said voice coils within said hollow volume permanent magnet;

electrically communicating said plurality of cylindrically shaped voice coils to an incoming audio voltage;

applying any audio voltage on said voice coils thereby (i) generating a magnetic field within said voice coils; and (ii) reciprocally moving said plurality of voice coils and plurality of diaphragms; and converting said audio voltage applied to sound waves in the full spectral range of an audio voltage, wherein said tweeter moves independently and within a hollow volume of said midrange driver, and wherein said midrange driver moves independently within a hollow volume of said woofer.

18. The method according to claim 17, additionally comprising at least one step selected from a group consisting of (a) shaping said permanent magnet in a cylindrical shape; (b) defining the movement of each of said voice coil coupled to said diaphragm is defined according to parameters selected from a group consisting of the applied audio voltage and the spectral response driver; (c) selecting the shape of said diaphragms from a group consisting of conically shape or dome shape; (d) designing said diaphragms in an a-spherical shape for optimal performance; (e) packing said voice coil coupled to said diaphragm in one compact loudspeaker unit; and any combination thereof.

* * * * *